United States Patent [19]

Asanomi

[11] Patent Number: 4,674,452

[45] Date of Patent: Jun. 23, 1987

[54] CAMSHAFT DRIVING SYSTEM FOR INTERNAL COMBUSTION ENGINE

[75] Inventor: Koji Asanomi, Hiroshima, Japan

[73] Assignee: Mazda Motor Corporation, Japan

[21] Appl. No.: 868,062

[22] Filed: May 29, 1986

[30] Foreign Application Priority Data

May 29, 1985 [JP] Japan ..... 60-117532

[51] Int. Cl.[4] ..... F01L 1/26

[52] U.S. Cl. ..... 123/90.31; 123/90.27

[58] Field of Search ..... 123/90.31, 90.27

[56] References Cited

U.S. PATENT DOCUMENTS

| | | | |
|---|---|---|---|
| 3,673,990 | 7/1972 | Alfieri | 123/90.31 |
| 4,230,074 | 10/1980 | Ichikawa et al. | 123/90.31 |
| 4,480,603 | 11/1984 | Tsuboi | 123/90.31 |
| 4,553,473 | 11/1985 | Ichida et al. | 123/90.31 |
| 4,589,382 | 5/1986 | Tsuboi | 123/90.31 |
| 4,610,224 | 9/1986 | Fujita | 123/90.31 |

FOREIGN PATENT DOCUMENTS

| | | | |
|---|---|---|---|
| 210110 | 12/1982 | Japan | 123/90.31 |
| 15612 | 1/1984 | Japan | 123/90.27 |
| 70820 | 4/1984 | Japan | 123/90.31 |
| 211705 | 11/1984 | Japan | 123/90.31 |
| 230503 | 11/1985 | Japan | 123/90.31 |

*Primary Examiner*—Ira S. Lazarus

*Attorney, Agent, or Firm*—Gerald J. Ferguson, Jr.; Michael P. Hoffman; Ponni S. Malamud

[57] ABSTRACT

A camshaft driving system for a DOHC engine having a pair of cylinder rows which are displaced from each other in the axial direction of the crankshaft so that a vacant space is formed in front of one of the cylinder rows and behind the other cylinder row. One of the camshafts in each cylinder row is provided with a timing pulley. The timing pulleys of the respective cylinder rows are arranged to be driven by the crankshaft of the engine by way of transmission means such as a chain or a timing belt passed around a crank pulley fixed to the crankshaft and the timing pulleys. The driving force transmitted to said one of the camshafts in each cylinder row is further transmitted to the other camshaft in each cylinder row by way of a driving force transmission means. The driving force transmission means in the rearwardly displaced cylinder row is disposed in the vacant space formed in front of the cylinder row and the driving force transmission means in the forwardly displaced cylinder row is disposed in the vacant space formed behind the cylinder row.

14 Claims, 4 Drawing Figures

CAMSHAFT DRIVING SYSTEM FOR INTERNAL COMBUSTION ENGINE

BACKGROUND OF THE INVENTION

1. Field of the Invention

This invention relates to a camshaft driving system for an internal combustion engine, and more particularly to a camshaft driving system for a DOHC (double-overhead-camshaft) engine having two rows of cylinders.

2. Description of the Prior Art

There has been known a DOHC engine having two rows of cylinders in which a pair of camshafts, one for driving the intake valves and the other for driving the exhaust valves, are provided in the cylinder head of each of the cylinder rows, and the cylinder rows are displaced from each other in the axial direction of the crankshaft so that a vacant space is formed in front of one of the cylinder rows and behind the other cylinder row.

In such an engine, a crank pulley on the crankshaft and a pair of timing pulleys fixed to the camshafts for the intake valves and the exhaust valves respectively are operatively connected with each other by a single timing belt. This arrangement is disadvantageous from the viewpoint of use of space especially in the direction of width of the engine in that, since the ratio of the rotational speed of the camshafts to that of the crankshaft is fixed (for example, in a fourcycle engine, the camshafts should make two revolutions per one revolution of the crankshaft) and the minimum diameter of the crank pulley is inherently determined by the surface pressure acting on the timing belt and the like, the diameter of the timing pulleys is determined, that is, reduction in the diameter of the timing pulleys is limited.

In Japanese Unexamined Patent Publication No. 54(1979)-50718, there is disclosed an engine in which an interlocking mechanism for connecting, to the crankshaft, the camshafts for driving the intake and exhaust valves in the rearwardly displaced cylinder row is disposed in the vacant space provided in front of the cylinder row and an interlocking mechanism for connecting, to the crankshaft, the camshafts for driving the intake and exhaust valves in the forwardly displaced cylinder row is disposed in the vacant space provided behind the cylinder row. However this approach cannot substantially contribute to reduction of the engine size since the interlocking mechanism is provided for each cylinder row and accordingly the overall length of the engine is increased.

SUMMARY OF THE INVENTION

In view of the foregoing observations and description, the primary object of the present invention is to provide a camshaft driving system for a DOHC engine having a pair of cylinder rows which can reduce the width of the engine without increasing the overall length of the engine.

In accordance with the present invention, there is provided an improved camshaft driving system for a DOHC engine having a pair of cylinder rows which are displaced from each other in the axial direction of the crankshaft so that a vacant space is formed in front of one of the cylinder rows and behind the other cylinder row. One of the camshafts in each cylinder row is provided with a timing pulley. The timing pulleys of the respective cylinder rows are arranged to be driven by the crankshaft of the engine by way of a transmission means such as a chain or a timing belt passed around a crank pulley fixed to the crankshaft and the timing pulleys. The driving force transmitted to said one of the camshafts in each cylinder row is further transmitted to the other camshaft in each cylinder row by way of a driving force transmission means. The driving force transmission means in the rearwardly displaced cylinder row is disposed in the vacant space formed in front of the cylinder row and the driving force transmission means in the forwardly displaced cylinder row is disposed in the vacant space formed behind the cylinder row. As the driving force transmission means, a chain or a timing belt can be used, for example.

DESCRIPTION OF THE PREFERRED EMBODIMENTS

Figure 1:
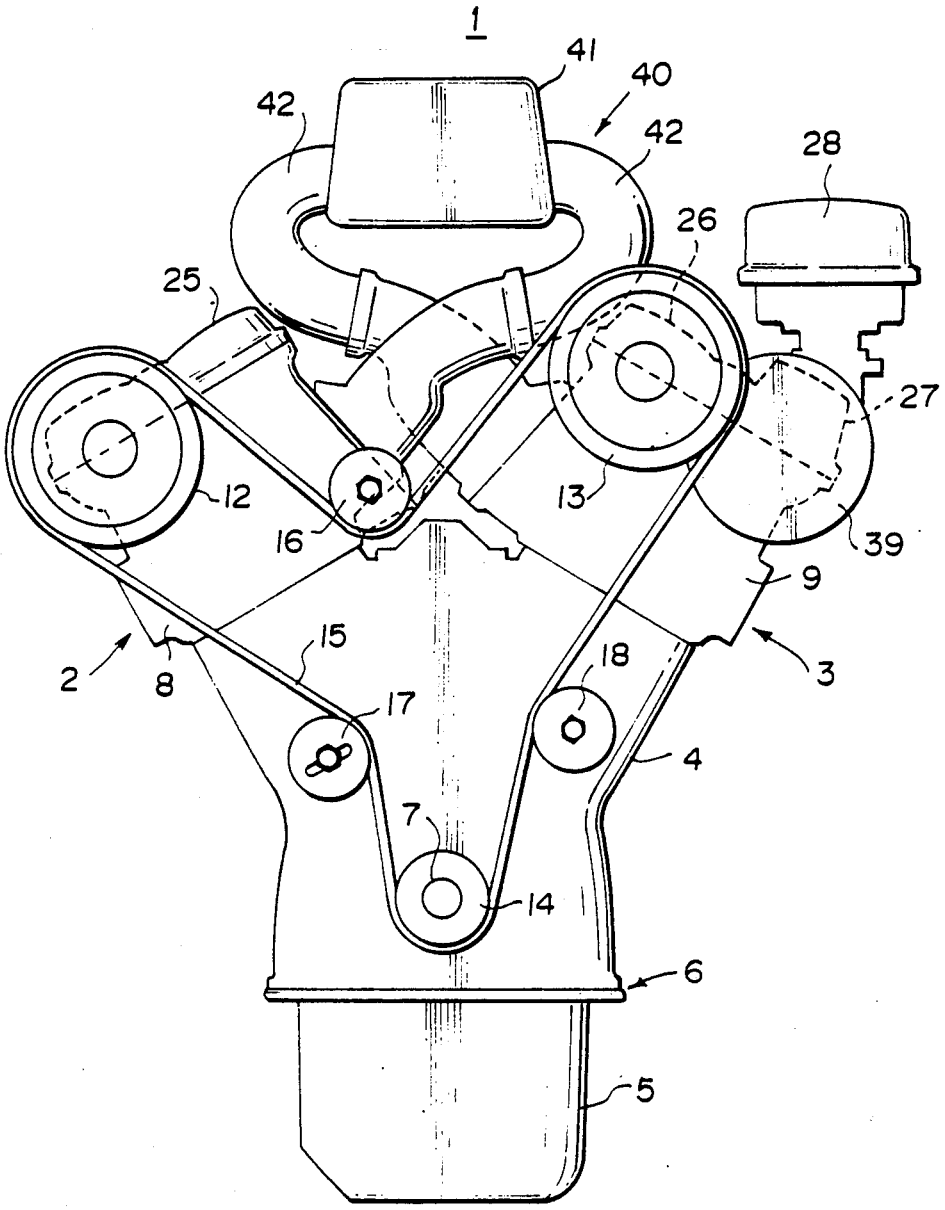
FIG. 1 is a front view of a DOHC V-type engine provided with a camshaft driving system in accordance with an embodiment of the present invention.
Figure 2:
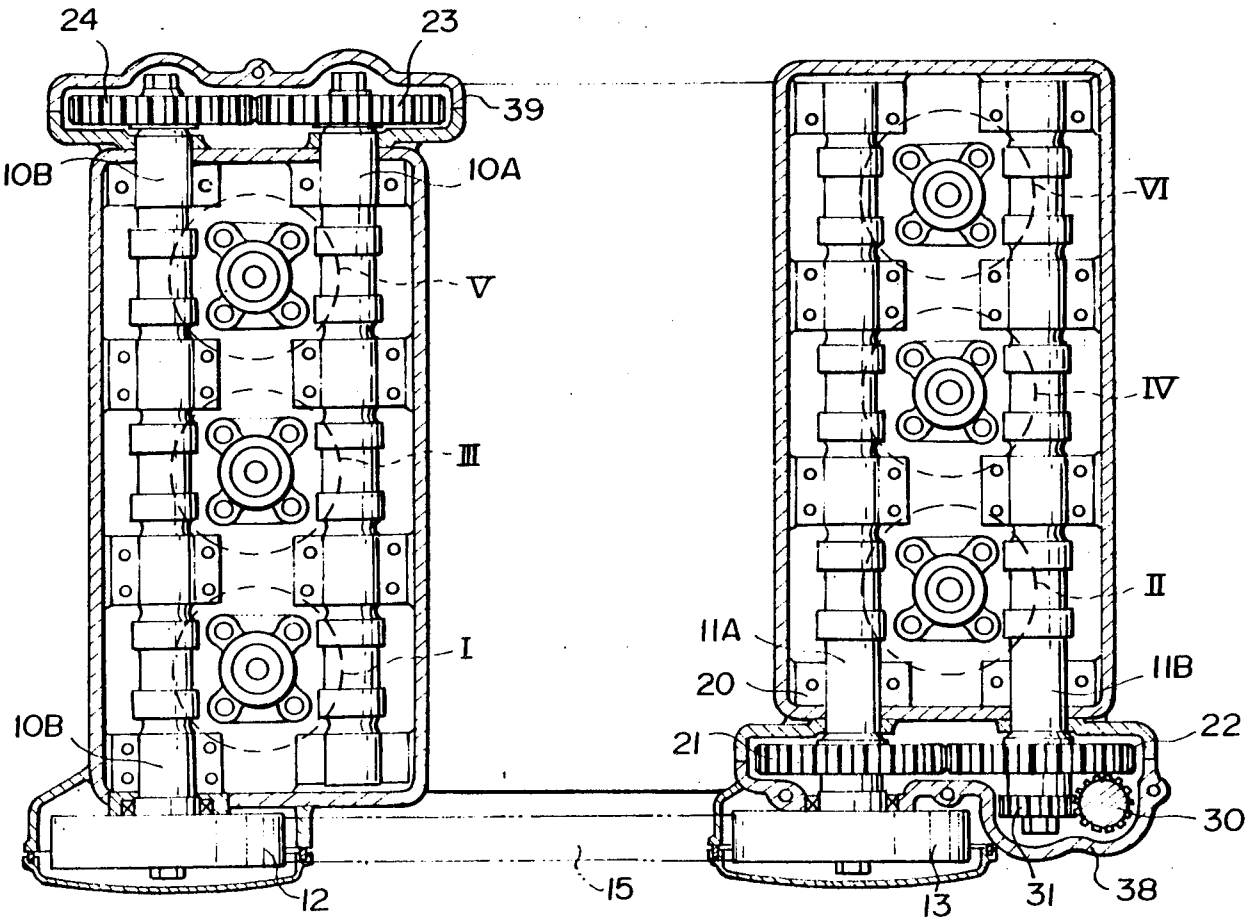
FIG. 2 is a plan view partly in cross-section of the engine.

In FIGS. 1 and 2, a DOHC V-type engine 1 provided with a camshaft driving system in accordance with an embodiment of the present invention has first and second cylinder rows 2 and 3. On the lower surface of the cylinder block 4 of the engine 1 is mounted an oil pan 5. A crank case 6 is formed by the lower portion of the cylinder block 4 and the oil pan 5 and a crankshaft 7 is disposed in the crank case 6.

Figure 3:
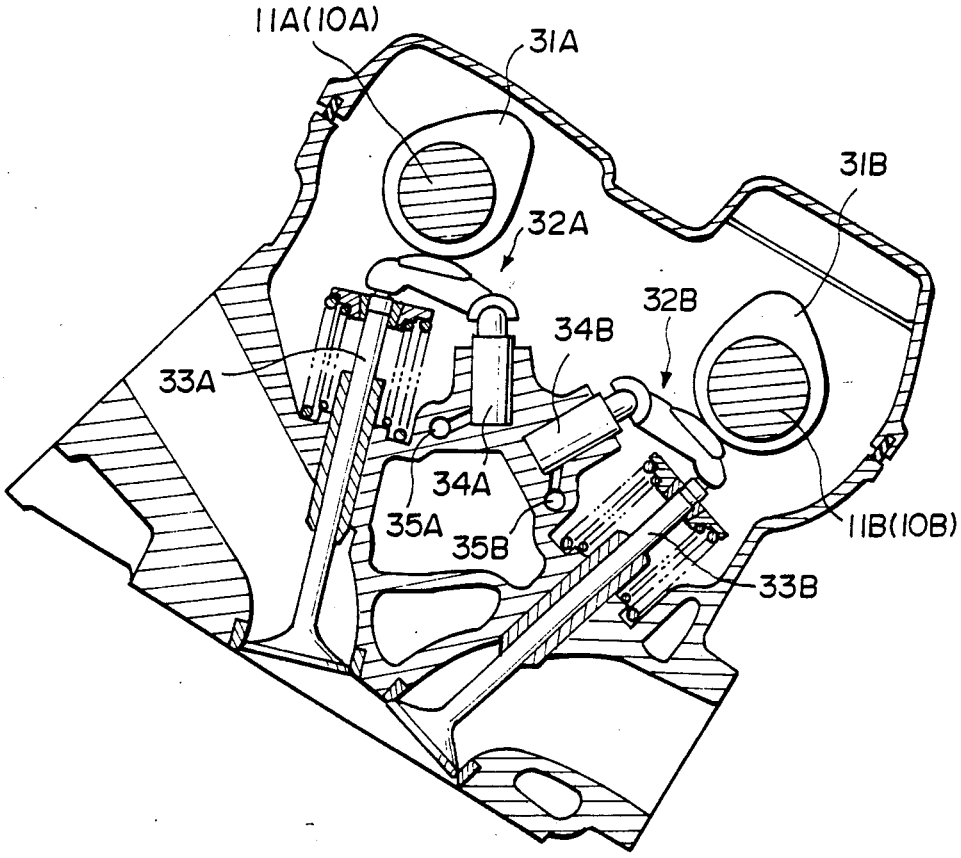
FIG. 3 is a fragmentary cross-sectional view of the engine.

Cylinder heads 8 and 9 of respectively the first and second cylinder rows 2 and 3 are mounted on the top of the cylinder block 4 in an air-tight fashion. A camshaft 10A for driving the intake valves in the first cylinder row 2 and a camshaft 11A for driving the intake valves in the second cylinder row 3 are mounted in the respective cylinder heads 8 and 9 symmetrically with respect to the center between the first and second cylinder rows 2 and 3 as viewed in the direction of the crankshaft 7. Similarly a camshaft 10B for driving the exhaust valves in the first cylinder row 2 and a camshaft 11B for driving the exhaust valves in the second cylinder row 3 are mounted in the respective cylinder heads 8 and 9 symmetrically with respect to the center between the first and second cylinder rows 2 and 3 as viewed in the direction of the crankshaft 7. The camshaft for driving the intake valves will be referred to as "intake camshaft" and the camshaft for driving the exhaust valves will be referred to as "exhaust camshaft", hereinbelow. As clearly shown in FIG. 3, the intake valve 33A of each cylinder is opened and closed by one of cams 31A provided on each of the intake camshafts 10A and 11A by way of one of rocker arms 32A. Similarly, the exhaust valve 33B of each cylinder is opened and closed by one of cams 31B provided on each of the exhaust camshafts 10B and 11B by way of one of rocker arms 32B. Hydraulic lash adjusters 34A and 34B for supporting the rocker arms 32A and 32B respectively are provided between the intake and exhaust camshafts 11A (10A) and 11B (10B). Reference numerals 35A and 35B denote oil feed passages for the hydraulic lash adjusters 34A and 34B respectively.

As shown in FIG. 2, the intake camshafts 10A and 11A of the first and second cylinder rows 2 and 3 are disposed on the inner side of the engine with respect to the exhaust camshafts 10B and 11B. Timing pulleys 12 and 13 are respectively fixed to the front end portions of the exhaust camshaft 10B in the first cylinder row 2 and the intake camshaft 11A in the second cylinder row 3, and a crank pulley 14 is fixed to the front end portion of the crankshaft 7. A timing belt 15 is passed around the timing pulleys 12 and 13 and the crank pulley 14 to operatively connect the camshafts 10B and 11A and the crankshaft 7 so that the camshafts 10B and 11A are driven by the crankshaft 7 in synchronization with each other. Reference numeral 16 denotes an idler provided between the timing pulleys 12 and 13 to guide the timing belt 15 along the V-shaped cylinder banks, and reference numerals 17 and 18 respectively denote a tensioner provided on the slack side of the timing belt 15 and an idler provided on the tight side of the same. Instead of the timing belt 15, other transmission means such as a chain may be used.

The first cylinder row 2 consists of No. 1 cylinder, No. 3 cylinder and No. 5 cylinder and the second cylinder row 3 consists of No. 2 cylinder, No. 4 cylinder and No. 6 cylinder. The pistons in No. 1 to No. 6 cylinders are each connected to the crankshaft 7 by a connecting rod (not shown), in this order from the front. The cylinders of one cylinder row are positioned to alterable with the cylinders in the other cylinder row in the axial direction of the crankshaft 7, and the second cylinder row 3 is displaced rearwardly with respect to the first cylinder row 2 in the axial direction of the crankshaft so that the distance between No. 2 cylinder (i.e., the frontmost cylinder in the second cylinder row) and the timing pulley 13 is larger than the distance between No. 1 cylinder (i.e., the frontmost cylinder in the first cylinder row) and the timing pulley 12.

A gear 21 is mounted on the intake camshaft 11A of the second cylinder row 3 between the timing pulley 13 and the frontmost of the bearings supporting the intake camshaft 11A which is indicated at 20 in FIG. 2. Another gear 22 is mounted on the front end portion of the exhaust camshaft 11B of the second cylinder row 3. The gears 21 and 22 are in mesh with each other so that the exhaust camshaft 11B is driven in synchronization with the intake camshaft 11A.

Gears 23 and 24 are respectively mounted on the rear end portions of the intake and exhaust camshafts 10A and 10B of the first cylinder row 2, and are in mesh with each other so that the intake camshaft 10A is driven in synchronization with the exhaust camshaft 10B. Thus, the cylinder heads 8 and 9 may be the same parts.

Further, the intake and exhaust camshafts 10A and 10B of the first cylinder row 2 and the intake and exhaust camshafts 11A and 11B are symmetrically disposed with respect to the center therebetween as viewed in the direction of the crankshaft 7, and the intake camshafts 10A and 11A are rotated in opposite directions and the exhaust camshafts 10B and 11B are rotated in opposite directions. That is, the first and second cylinder rows 2 and 3 are symmetrical with respect to a point as viewed from above the engine. Accordingly, the intake camshafts 10A and lIA may be the same in the form of the cams thereon, and similarly, the exhaust camshafts 10B and 11B may be the same in the form of the cams thereon. Thus, the intake camshafts 10A and 11B may be the same parts and the exhaust camshafts 10B and 11B may be the same parts. Further, the relative position of the rocker arms 32A for driving the intake valves 33A to the cams 31A on the intake camshaft 10A (11A) may be the same as that of the rocker arms 32B for driving the exhaust valves 33B to the cams 31B on the exhaust camshaft 10B (11B). At the same time, layout of the oil feed passages 35A and 35B for the hydraulic lash adjuster 34A and 34B is facilitated.

As can be understood from the description above, the gears 21 and 22 and the gears 23 and 24 are respectively disposed in the vacant spaces which are formed in front of the second cylinder row 3 and behind the first cylinder row 2 and are generally inherent to DOHC V-type engines. The gears 21 and 22 are covered with a gear cover 38 separate from the cylinder head 9 and similarly the gears 23 and 24 are covered with a gear cover 39 separate from the cylinder head 8.

Head covers 25 and 26 are respectively mounted on the cylinder heads 8 and 9, and an oil separator 27 is provided above the exhaust camshafts 11B in the head cover 26.

Reference numeral 28 denotes a distributor to the rotational shaft of which is fixed a worm wheel 30. The worm wheel 30 is in mesh with a worm gear 31 fixed to the front end of the exhaust camshaft 11B in the second cylinder row 3 so that the distributor 28 is driven by the camshaft 11B. The worm wheel 30 and the worm gear 31 are in mesh with each other at a position on the outer side of the longitudinal axis of the exhaust camshaft 11B.

Between the first and second cylinder rows 2 and 3 is disposed an intake system 40 including a surge tank 41. Discrete intake passages 42 extend from the surge tank 41 to the inner sides of the right and left cylinder banks (first and second cylinder rows 2 and 3), and the intake camshafts 10A and 11B are disposed on inner side of the exhaust camshafts 10B and 11B.

When the crankshaft 7 rotates, the exhaust camshaft 10B of the first cylinder row 2 and the intake camshaft 11A of the second cylinder row 3 are rotated in the same direction as the crankshaft 7. The rotation of the camshafts 10B and 11A is transmitted to the intake camshaft 10A and the exhaust camshaft 11B respectively by way of the mesh of the gears 21 and 22 and the mutual mesh of the gears 23 and 24 to rotate the camshafts 10A and 11B in the direction opposite to the crankshaft 7. That is, the intake camshafts 10A and 11A of the first and second cylinder rows 2 and 3 are rotated in opposite directions and the exhaust camshafts 10B and 11B of the first and second cylinder rows 2 and 3 are rotated in opposite directions.

In this embodiment, the gears 21 and 22 and the gears 23 and 24 for transmitting the driving force from one of the camshafts to the other in the respective cylinder rows are disposed in the dead spaces formed in front of one of the cylinder rows and behind the other cylinder row. Therefore, the number of the timing pulleys can be reduced to reduce the engine width without increasing the engine length. Particularly the arrangement of this embodiment in which the camshafts of the both cylinder rows are driven by one timing belt can contribute to reduction of the engine length more than the arrangement in which the camshafts of each cylinder row are driven by one timing belt. As described above, the first and second cylinder rows 2 and 3 are symmetrical with respect to the center of the engine. Accordingly, the intake camshafts 10A and 11A may be the same in the form of the cams thereon, and similarly, the exhaust camshafts 10B and 11B may be the same in the form of the cams thereon. At the same time, the cylinder heads may be the same in shape, and the layout of the intake manifold and the exhaust manifold can be facilitated.

Though, in the above embodiments, the camshafts 10A and 10B are operatively connected by way of the gears 23 and 24 and the camshafts 11A and 11B are operatively connected by way of the gears 21 and 22, the operative connections between the two camshafts in each cylinder row may be effected by a chain or a timing belt.

Figure 4:
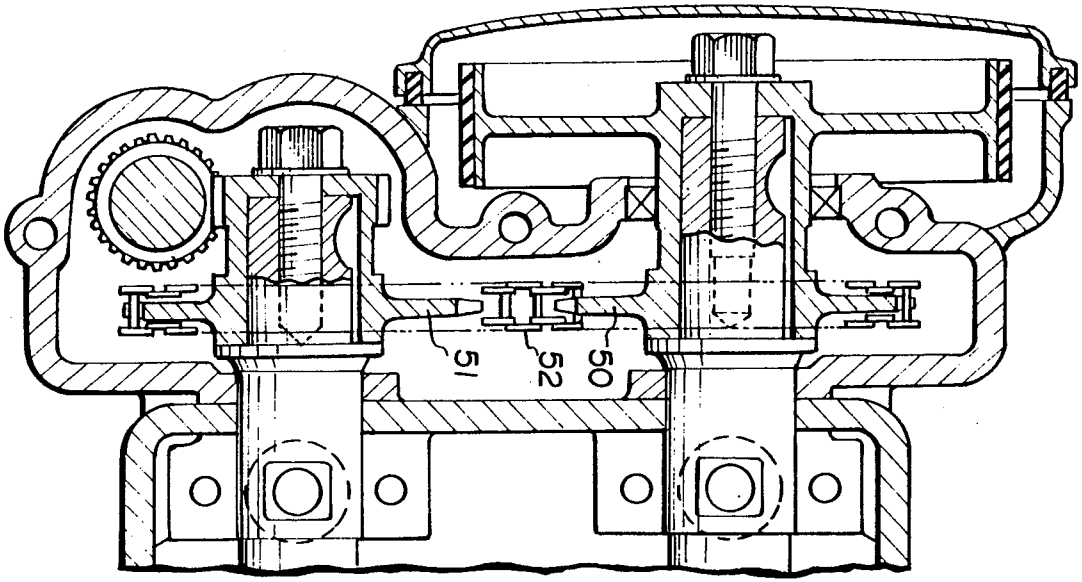
FIG. 4 is a fragmentary cross-sectional view for illustrating a modification of the camshaft driving system of FIG. 1.

In the modification of the present invention shown in FIG. 4, the intake and exhaust camshafts 10A and 10B (11A and 11B) are provided with sprockets 50 and 51, and a chain 52 is passed around the sprockets 50 and 51 to transmit rotation of one of the camshafts to the other. In this case, the intake exhaust camshafts 10A, 11A, 10B and 11B rotate in the same direction, and accordingly, the cams on the camshafts in the respective cylinder rows must differ from each other in cam form. Otherwise, a direct driving system can be used in which the cams work directly on the valve bucket without the rocker arms intervening therebetween.

Further, the present invention can be applied to a horizontally opposed engine. Further, when each of the intake camshafts is connected with the crankshaft by a timing belt (using two timing belts), all the timing pulleys on the camshafts can be disposed on the inner side of the engine, which further contributes to reduction of the engine size.

I claim:

1. A camshaft driving system for a double overhead camshaft engine having first and second cylinder rows which extend in parallel to the crankshaft of the engine, the second cylinder row being rearwardly displaced from the first cylinder row in the axial direction of the crankshaft so that vacant spaces are formed respectively behind the first cylinder row and in front of the second cylinder row, all the pistons in the cylinders of the first and second cylinder rows being connected to the crankshaft and a pair of camshafts for driving the intake and exhaust valves being provided in the cylinder head of each cylinder row to extend in the direction of the crankshaft, the camshaft driving system comprising a timing pulley provided on one of the intake and exhaust camshafts of each cylinder row to rotate together with the camshaft, a crank pulley driven by the crankshaft, a first driving force transmission means which transmits rotation of the crank pulley to the timing pulleys of the first and second cylinder rows, a second driving force transmission means for transmitting rotation of the timing pulley of the first cylinder row to the other of the camshafts of the first cylinder row, and a third driving force transmission means for transmitting rotation of the timing pulley of the second cylinder row to the other of the camshafts of the second cylinder row, the second driving force transmission means being disposed in the vacant space behind the first cylinder row and the third driving force transmission means being disposed in the vacant space in front of the second cylinder row.

2. A camshaft driving system as defined in claim 1 in which said engine is a V-type engine and said timing pulleys of the first and second cylinder rows are driven by the first driving force transmission means which is common to the both timing pulleys.

3. A camshaft driving system as defined in claim 2 in which said one of the camshafts of one of the cylinder rows on which the timing pulley is provided is the camshaft disposed on the inner side in the cylinder row and said one of the camshafts of the other cylinder row on which the timing pulley is provided is the camshaft disposed on the outer side in the cylinder row, the timing pulleys of the first and second cylinder rows being rotated in the same direction, the camshafts of each cylinder row being rotated in opposite directions, the intake valves in each cylinder row being arranged in a row and the exhaust valves in each cylinder row being arranged in a row disposed on the inner side or the outer side of the row of the intake valves.

4. A camshaft driving system as defined in claim 3 in which said second and third driving force transmission means comprise a gear.

5. A camshaft driving system as defined in claim 3 in which said driving force transmission means of each cylinder row is covered with a cover separate from the cylinder head, and the cylinder heads for the first and second cylinder rows are the same in shape.

6. A camshaft driving system as defined in claim 3 in which said row of the intake valves is disposed on the inner side of the row of the exhaust valves in each cylinder row.

7. A camshaft driving system as defined in claim 3 in which said second and third driving force transmission means comprise a chain.

8. A camshaft driving system as defined in claim 1 in which said timing pulleys are provided on the camshafts disposed on the same side in the respective cylinder rows as viewed in the direction of the crankshaft, and the camshaft disposed on the right hand side in one of the cylinder rows and the camshaft disposed in the left hand side in the other cylinder row are arranged to drive the intake valves, the other camshafts of the cylinder rows being arranged to drive the exhaust valves.

9. A camshaft driving system as defined in claim 1 in which said driving force transmission means of each cylinder row is covered with a cover separate from the cylinder head, and the cylinder heads for the first and second cylinder rows are the same in shape.

10. A camshaft driving system as defined in claim 1 in which one of the camshafts in one of the cylinder rows is provided with the driving force transmission means and the timing pulley on one end portion, and the other camshaft is provided with the driving force transmission means and an auxiliary mechanism driving gear for driving an auxiliary mechanism.

11. A camshaft driving system as defined in claim 10 in which said auxiliary mechanism is a distributor.

12. A camshaft driving system as defined in claim 1 in which said driving force transmission means comprises a pair of gears which are provided on the camshafts in each cylinder row and in mesh with each other.

13. A camshaft driving system as defined in claim 1 in which said timing pulleys of the first and second cylinder rows are driven by the first driving force transmission means which is common to the both timing pulleys.

14. A camshaft driving system as defined in claim 2 in which said second and third driving force transmission means comprise a gear.

* * * * *